US010371476B1

(12) United States Patent
Oglesby

(10) Patent No.: US 10,371,476 B1
(45) **Date of Patent: *Aug. 6, 2019**

(54) 3-D PRINTED/MANUFACTURED SUPPRESSOR ELEMENT

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/188,565

(22) Filed: Nov. 13, 2018

Related U.S. Application Data

(63) Continuation of application No. 15/405,873, filed on Jan. 13, 2017, now Pat. No. 10,126,084, which is a continuation-in-part of application No. 14/881,368, filed on Oct. 13, 2015, now Pat. No. 9,658,010.

(60) Provisional application No. 62/063,197, filed on Oct. 13, 2014.

(51) Int. Cl.
*F41A 21/30* (2006.01)

(52) U.S. Cl.
CPC ..... *F41A 21/30* (2013.01)

(58) Field of Classification Search
CPC ..... F41A 21/26; F41A 21/30; F41A 21/32; F41A 21/325; F41A 21/34; F41A 21/36; F41A 21/482
USPC ..... 89/14.4, 14.3; 181/223
See application file for complete search history.

(56) References Cited

U.S. PATENT DOCUMENTS 863,342 A * 8/1907 Alber ..... F01N 1/22 181/271
944,646 A * 12/1909 Xardell et al. ..... F01N 1/089 181/275
1,087,397 A * 2/1914 Persson ..... F41A 21/30 181/236
1,290,853 A * 1/1919 Sturgeon ..... F41A 13/12 89/14.1
1,427,802 A * 9/1922 Goodwin ..... F41A 21/30 181/223
2,402,632 A * 6/1946 Ivanovic ..... F41A 21/32 89/14.1
2,514,996 A * 7/1950 Faust, Jr. ..... F41A 21/30 181/223
2,872,848 A * 2/1959 Schuessler ..... F41A 21/36 89/14.3
4,829,877 A * 5/1989 Zerega ..... F41A 21/26 434/18
6,796,214 B2 * 9/2004 Hausken ..... F41A 21/30 89/14.2
7,237,467 B1 * 7/2007 Melton ..... F41A 21/30 89/14.4

(Continued)

*Primary Examiner* — Derrick R Morgan
(74) *Attorney, Agent, or Firm* — Shaddock Law Group, PC

(57) ABSTRACT

A suppressor element having at least some of a body portion having a body cavity defined therein; a shielding portion, wherein the shielding portion is positioned over at least a portion of the body portion, such that a venting cavity is defined between at least a portion of the body portion and at least a portion of the shielding portion; one or more support elements that extend between the body portion and the shielding portion; and a rear cap that extends from a body portion first end, wherein the rear cap includes a mounting aperture, wherein the mounting aperture allows the rear cap to be attached or coupled to a barrel or muzzle device of a firearm, and wherein at least the body portion, the shielding portion, and the one or more support elements, are formed as an integral or monolithic unit.

20 Claims, 14 Drawing Sheets

(56) References Cited

U.S. PATENT DOCUMENTS 7,412,917 B2 * 8/2008 Vais ..... F41A 21/30 181/223
7,600,606 B2 * 10/2009 Brittingham ..... F41A 21/30 181/223
7,789,008 B2 * 9/2010 Petersen ..... F41A 21/30 89/14.4
7,832,323 B1 * 11/2010 Davies ..... F41A 21/30 89/14.4
8,087,338 B1 * 1/2012 Hines ..... F41A 21/30 181/223
8,807,272 B2 * 8/2014 Bladen ..... F41A 21/30 181/223
8,844,422 B1 * 9/2014 Klett ..... F41A 21/30 89/14.2
8,875,612 B1 * 11/2014 Klett ..... F41A 21/30 89/14.4
8,967,325 B1 * 3/2015 Cronhelm ..... F41A 13/00 181/223
9,347,727 B1 * 5/2016 Cler ..... F41A 21/30
9,500,427 B1 * 11/2016 Larue ..... F41A 21/30
9,658,010 B1 * 5/2017 Oglesby ..... F41A 13/12
9,709,354 B2 * 7/2017 Larue ..... F41A 21/30
2007/0107590 A1 * 5/2007 Silvers ..... F41A 21/30 89/14.4
2010/0275493 A1 * 11/2010 Polovnev ..... F41A 21/34 42/90
2011/0088540 A1 * 4/2011 Brittingham ..... F41A 21/26 89/14.5
2012/0272818 A1 * 11/2012 Dueck ..... F41A 21/30 89/14.4
2013/0319790 A1 * 12/2013 Bladen ..... F41A 21/30 181/223
2014/0007481 A1 * 1/2014 Tresserras Torre ..... F41A 21/02 42/76.1
2014/0224574 A1 * 8/2014 Latka ..... F41A 21/30 181/223
2015/0101882 A1 * 4/2015 Moss ..... F41A 21/30 181/223
2015/0260473 A1 * 9/2015 Barney ..... F41A 21/30 89/14.4
2015/0276340 A1 * 10/2015 Vais ..... F41A 21/30 181/223
2015/0292829 A1 * 10/2015 Pietila ..... F41A 21/30 181/223
2016/0061551 A1 * 3/2016 Petersen ..... F41A 21/28 89/14.4
2016/0123689 A1 * 5/2016 Maeda ..... F41A 21/30 89/14.3
2017/0030672 A1 * 2/2017 Larue ..... F41A 21/30
2017/0067711 A1 * 3/2017 Slack ..... F41A 21/30
2017/0102202 A1 * 4/2017 Augustine ..... F41A 21/30
2017/0199002 A1 * 7/2017 Hwang ..... F41A 21/36
2017/0205173 A1 * 7/2017 Thomas ..... F41A 3/40
2017/0205175 A1 * 7/2017 Garst ..... F41A 21/30
2018/0038663 A1 * 2/2018 Larue ..... F41A 3/66
2019/0072352 A1 * 3/2019 Garst ..... F41A 21/30

* cited by examiner

3-D PRINTED/MANUFACTURED SUPPRESSOR ELEMENT

ACROSS-REFERENCE TO RELATED APPLICATIONS

This patent application is a continuation of U.S. patent application Ser. No. 15/405,873, filed Jan. 13, 2017, which is a continuation-in-part of U.S. patent application Ser. No. 14/881,368, filed Oct. 13, 2015, which claims the benefit of U.S. Patent Application Ser. No. 62/063,197, filed Oct. 13, 2014, the disclosures of which are incorporated herein by reference in their entireties.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of firearms. More specifically, the present disclosure relates to printed suppressor elements for use with firearms.

2. Description of Related Art

A suppressor or silencer is a device that is typically attached to or an integral part of a barrel of a firearm or air gun. The suppressor acts to reduce the amount of noise and visible muzzle flash generated when a firearm is fired. Suppressors are typically constructed of a metal cylinder with internal baffles to reduce the sound of firing by slowing and cooling the rapidly expanding gases from the firing of a cartridge through a series of chambers. Because the propellant gases exits the suppressor over a longer period of time and at a greatly reduced velocity, a reduced noise signature is produced.

Typically, suppressors are integral to the firearm's barrel, directly threaded to the barrel of the firearm (via interaction of an internally threaded portion of the suppressor and an externally threaded portion of the exterior of the barrel), or are attached or coupled to a "quick-detach" flash hider or other muzzle device (which typically includes a locking mechanism that allows the suppressor to be quickly installed or removed from the firearm).

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, suppressors are typically a hollow metal tube manufactured from steel, aluminum, or titanium with various baffles inserted therein to create a number of expansion chambers. Unfortunately, heat is created during a firearm firing sequence and any attached suppressor can become extremely hot during the firing sequence. Known suppressors can produce an extremely high heat signature and are not often efficient in dissipating heat, particularly if a fabric cover is placed over the suppressor to reduce the heat signature of the suppressor or protect the user from being burned by the suppressor.

The present disclosure comprises various embodiments of a 3-D printed suppressor element that provides a ducted thermal extraction system for at least a portion of the suppressor body portion. In various exemplary, nonlimiting embodiments, the 3-D printed suppressor element of the present disclosure comprises at least some of a body portion, wherein the body portion extends, along a longitudinal axis, from a body portion rear end to a body portion front end, wherein one or more interior body portion side walls extend from the open body portion rear end to a body portion bottom wall, wherein a body cavity is defined between the open body portion first end, the body portion side wall(s) and the body portion bottom wall, wherein a body portion exit aperture is formed through the body portion bottom wall, and wherein the body portion first end includes an externally threaded portion; a shielding portion, wherein the shielding portion extends, along a longitudinal axis, from a shielding portion rear end to a shielding portion front end, wherein one or more interior shielding portion side walls extend from the open shielding portion rear end to a shielding portion bottom wall, wherein a shielding portion exit aperture is formed through the shielding portion bottom wall, wherein the shielding portion is positioned over at least a portion of the body portion, such that the body portion exit aperture is aligned with the shielding portion exit aperture, wherein a venting cavity is defined between at least a portion of the body portion and at least a portion of the shielding portion, and wherein a protrusion is formed so as to extend from the shielding portion front end around at least a portion of the exit aperture; one or more support elements extending, at spaced apart locations, between the body portion and the shielding portion; one or more additional support elements extending, at spaced apart locations, between the body portion front end and the shielding portion bottom wall; and a rear cap, wherein the rear cap includes an internally threaded portion, having internal threads formed so as to interact with at least a portion of the externally threaded portion of the body portion first end, and wherein the rear cap includes a mounting aperture, wherein the mounting aperture allows the rear cap to be attached or coupled to a barrel or muzzle device of a firearm.

In certain exemplary, nonlimiting embodiments, the exit aperture is formed proximate a center of the body portion bottom wall. In certain other exemplary embodiments, the exit aperture is formed offset from the center of the body portion bottom wall.

In certain exemplary, nonlimiting embodiments, the body cavity comprises an expansion chamber portion and a baffle stack chamber portion. The expansion chamber portion may optionally be formed so as to receive a diffractor at least partially therein, and wherein the baffle stack chamber portion is formed so as to receive one or more baffles therein.

In certain exemplary, nonlimiting embodiments, at least a portion of the body cavity is formed so as to accept recoil booster components therein.

In certain exemplary, nonlimiting embodiments, the shielding portion covers at least a portion of the body portion front end. The body portion and the shielding portion may optionally be arranged such that the body portion is fully contained within the shielding portion.

In certain exemplary, nonlimiting embodiments, the rear cap is repeatably threadedly attachable to or removable from the body portion and the rear cap may be threadedly attached to the body portion to maintain one or more baffles and/or a diffractor within the body cavity.

In certain exemplary, nonlimiting embodiments, the mounting aperture comprises an internally threaded mounting aperture. Alternatively, the mounting aperture may optionally be releasably attachable to a suppressor attachment device or a muzzle device.

In certain exemplary, nonlimiting embodiments, the venting cavity extends from one or more venting cavity entry apertures formed proximate the shielding portion rear end to the shielding portion exit aperture. Each of the one or more venting cavity entry apertures may optionally be defined between adjacent support elements, the body portion, and the shielding portion, proximate the shielding portion rear end and fluid communication between the venting cavity and an exterior of the shielding portion may optionally be provided by the one or more venting cavity entry apertures and the shielding portion exit aperture. In certain exemplary, nonlimiting embodiments, during a firing cycle, ambient air is drawn through the one or more venting cavity entry apertures, through the shielding portion exit aperture. In certain exemplary, nonlimiting embodiments, airflow is created within the venting cavity, between the one or more venting cavity entry apertures and the shielding portion exit aperture.

In certain exemplary, nonlimiting embodiments, the body portion, the shielding portion, and the one or more support elements are formed as an integral or one piece, monolithic unit, via 3-D printing or additive manufacturing. In other exemplary, nonlimiting embodiments, the body portion, the shielding portion, the one or more support elements, and the one or more additional support elements are formed as an integral or one piece, monolithic unit, via 3-D printing or additive manufacturing. In still other exemplary, nonlimiting embodiments, the body portion, the shielding portion, the one or more support elements, the one or more additional support elements, and one or more baffles are formed as an integral or one piece, monolithic unit, via 3-D printing or additive manufacturing. In still other exemplary, nonlimiting embodiments, the body portion, the shielding portion, the one or more support elements, the one or more additional support elements, one or more baffles, and a diffractor are formed as an integral or one piece, monolithic unit, via 3-D printing or additive manufacturing.

In certain exemplary, nonlimiting embodiments, at least one diffractor is positioned within the body cavity, wherein the diffractor includes a central aperture that, when aligned within the body cavity is aligned with the exit aperture of the body portion and the shielding portion, and wherein at least one supplemental aperture is also formed through at least a portion of the diffractor.

In certain exemplary, nonlimiting embodiments, one or more baffles are positioned within the body cavity, wherein each baffle comprises a substantially conical baffle, which is capable of being interlocked and stackable with adjacent baffles, wherein each baffle includes a central aperture that, when aligned within the body cavity is aligned with the exit aperture of the body portion and the shielding portion, and wherein at least one supplemental aperture is formed through at least a portion of each baffle.

In various exemplary, nonlimiting embodiments, the 3-D printed suppressor element of the present disclosure comprises at least some of a body portion, wherein the body portion extends, along a longitudinal axis, from a body portion rear end to a body portion front end, wherein one or more interior body portion side walls extend from the open body portion rear end to a body portion bottom wall, wherein a body cavity is defined between the open body portion first end, the body portion side wall(s) and the body portion bottom wall, wherein a body portion exit aperture is formed through the body portion bottom wall, and wherein the body portion first end includes an externally threaded portion; a shielding portion, wherein the shielding portion extends, along a longitudinal axis, from a shielding portion rear end to a shielding portion front end, wherein one or more interior shielding portion side walls extend from the open shielding portion rear end to a shielding portion bottom wall, wherein a shielding portion exit aperture is formed through the shielding portion bottom wall, wherein the shielding portion is positioned over at least a portion of the body portion, such that the body portion exit aperture is aligned with the shielding portion exit aperture, wherein a venting cavity is defined between at least a portion of the body portion and at least a portion of the shielding portion, and wherein the venting cavity extends from one or more venting cavity entry apertures formed proximate the shielding portion rear end to the shielding portion exit aperture; one or more support elements extending, at spaced apart locations, between the body portion and the shielding portion; one or more additional support elements extending, at spaced apart locations, between the body portion front end and the shielding portion bottom wall, wherein the body portion, the shielding portion, the one or more support elements, and the one or more additional support elements are formed as an integral or one piece, monolithic unit; and a rear cap, wherein the rear cap includes an internally threaded portion, having internal threads formed so as to interact with at least a portion of the externally threaded portion of the body portion first end, and wherein the rear cap includes a mounting aperture, wherein the mounting aperture allows the rear cap to be attached or coupled to a barrel or muzzle device of a firearm.

In certain exemplary, nonlimiting embodiments, the body portion, the shielding portion, the one or more support elements, and the one or more additional support elements are formed as an integral or one piece, monolithic unit, via 3-D printing or additive manufacturing. One or more baffles may also optionally be formed within a portion of the body cavity as an integral unit, via 3-D printing or additive manufacturing.

In various exemplary, nonlimiting embodiments, the 3-D printed suppressor element of the present disclosure comprises at least some of a body portion, wherein a body cavity is defined therein, and wherein a body portion exit aperture is formed through a body portion bottom wall; a shielding portion, wherein a shielding portion exit aperture is formed through a shielding portion bottom wall, wherein the shielding portion is positioned over at least a portion of the body portion, such that the body portion exit aperture is aligned with the shielding portion exit aperture, and wherein a venting cavity is defined between at least a portion of the body portion and at least a portion of the shielding portion; one or more support elements extending, at spaced apart locations, between the body portion and the shielding portion; and a rear cap, wherein the rear cap extends from the body portion, wherein the rear cap includes a mounting aperture that allows the rear cap to be attached or coupled to a barrel or muzzle device of a firearm, and wherein the body portion, the shielding portion, and the one or more support elements are formed as an integral or one piece, monolithic unit, via 3-D printing or additive manufacturing.

Accordingly, the present disclosure separately and optionally provides a 3-D printed suppressor element that provides cooling and heat shielding for a suppressor body portion.

The present disclosure separately and optionally provides a 3-D printed suppressor element that includes a suppressor body portion at least partially surrounded by a shielding portion.

The present disclosure separately and optionally provides a shielding portion that at least partially surrounds at least a portion of a suppressor body portion so there is a reduced heat signature to the 3-D printed suppressor element.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the present disclosure discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE PRESENT DISCLOSURE

Figure 1:
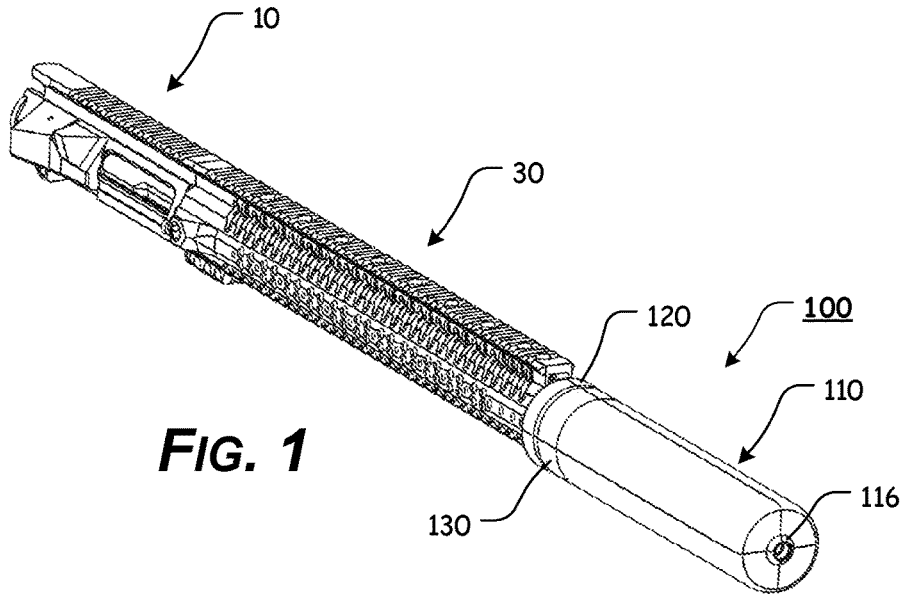
FIG. 1 illustrates a front perspective view of an exemplary embodiment of a 3-D printed suppressor element, according to the present disclosure.
Figure 2:
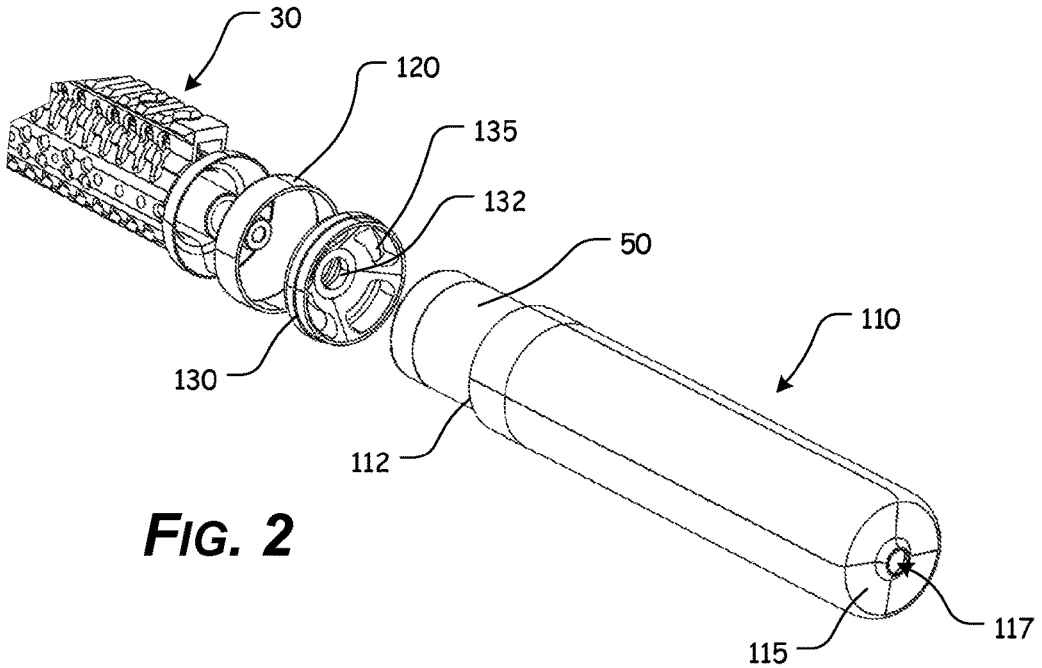
FIG. 2 illustrates a partial front perspective exploded view showing certain elements of an exemplary embodiment of a 3-D printed suppressor element, according to the present disclosure.
Figure 3:
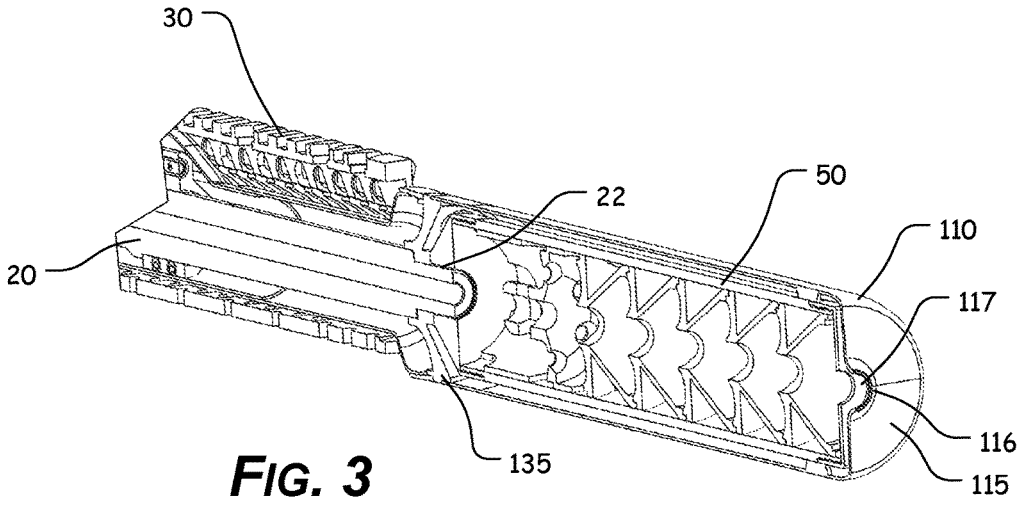
FIG. 3 illustrates a partial front perspective, cross-sectional view showing certain elements of an exemplary embodiment of a 3-D printed suppressor element with an exemplary diffractor and exemplary baffles, according to the present disclosure.
Figure 4:
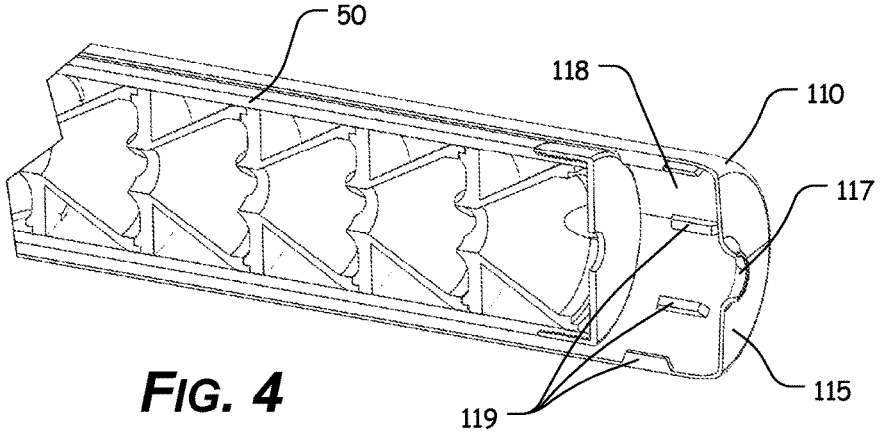
FIG. 4 illustrates a partial front perspective, more detailed cross-sectional view showing certain elements of an exemplary embodiment of a 3-D printed suppressor element with an exemplary diffractor and exemplary baffles, according to the present disclosure.
Figure 5:
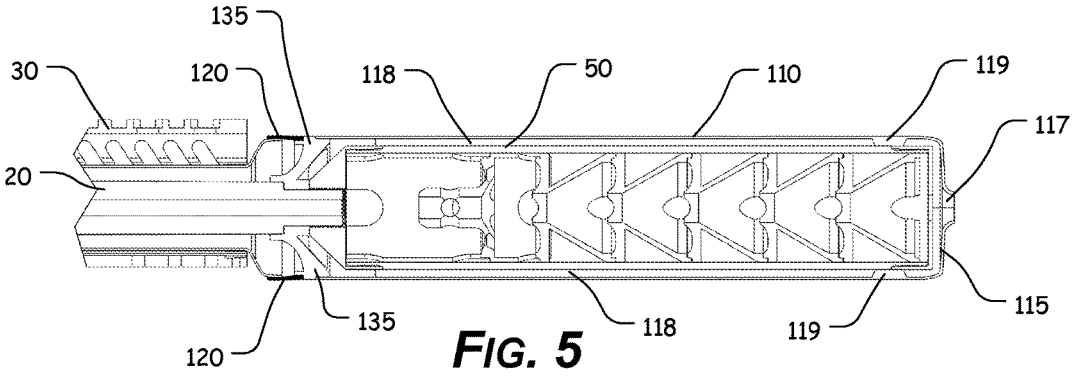
FIG. 5 illustrates a partial, side cross-sectional view showing certain elements of an exemplary embodiment of a 3-D printed suppressor element with an exemplary diffractor and exemplary baffles, according to the present disclosure.
Figure 6:
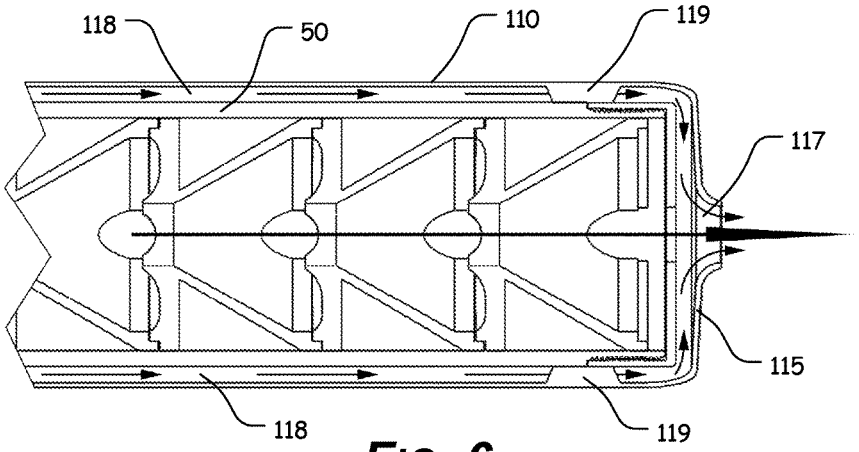
FIG. 6 illustrates a more detailed, partial side cross-sectional view showing certain elements of an exemplary embodiment of a 3-D printed suppressor element with an exemplary diffractor and exemplary baffles, according to the present disclosure.
Figure 7:
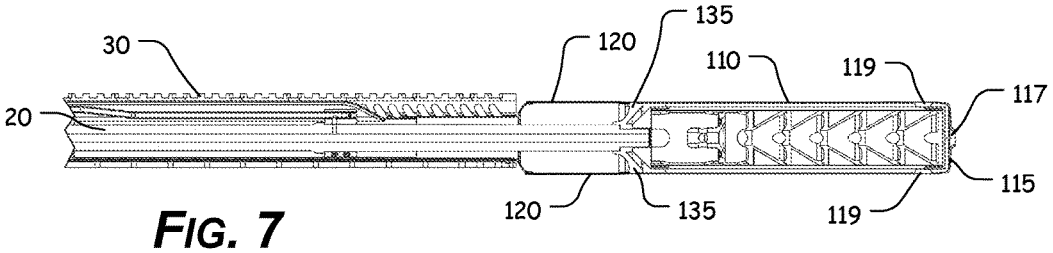
FIG. 7 illustrates a partial, side cross-sectional view showing certain elements of an exemplary embodiment of a 3-D printed suppressor element with an exemplary diffractor and exemplary baffles, according to the present disclosure.

For simplicity and clarification, the design factors and operating principles of the 3-D printed suppressor element according to the present disclosure are explained with reference to various exemplary embodiments of a 3-D printed suppressor element according to the present disclosure. The basic explanation of the design factors and operating principles of the 3-D printed suppressor element is applicable for the understanding, design, and operation of the present disclosure. It should be appreciated that the present disclosure can be adapted to many applications where heat shielding and/or thermal venting can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "3-D printed", "body portion", "thermal venting", and "shielding portion" are used for basic explanation and understanding of the operation of the systems, methods, and apparatuses of the present disclosure. Therefore, the terms "3-D printed", "body portion", and "shielding portion" are not to be construed as limiting the systems, methods, and apparatuses of the present disclosure. Thus, for example, the term 3-Dimensional printed, or "3-D printed", is to be understood to broadly include any 3-D printing, layer-by-layer fabrication, or additive manufacturing (AM) processes used to produce a three-dimensional object, in which successive layers of one or more materials are formed to create the object, including, but not limited to Binder Jetting, Directed Energy Deposition, Material Extrusion, Material Jetting, Powder Bed Fusion, Sheet Lamination, and Vat Photopolymerization.

For simplicity and clarification, the 3-D printed suppressor element of the present disclosure will be described as being used in conjunction with a barrel of a firearm, such as a rifle or carbine. However, it should be appreciated that these are merely exemplary embodiments of the 3-D printed suppressor element and are not to be construed as limiting the present disclosure. Thus, it should be understood and appreciated that the 3-D printed suppressor element of the present disclosure may be utilized in the same manner as a conventional or known suppressor.

Turning now to the drawing FIGS., FIGS. 1-3, 5, 7, 9, and 25-31 illustrate various exemplary embodiments of the present disclosure utilized in conjunction with certain components of an AR-15 style upper receiver 10. As is generally known, an AR-15 style upper receiver 10 may optionally include at least some of a barrel 20 that extends from a breach end to a muzzle end. At least a portion of the breach end of the barrel 20 is aligned with and inserted into a portion of the upper receiver 10. While not illustrated, the barrel 20 is typically secured to the upper receiver 10 via interaction of a threaded portion of the upper receiver 10 and an internally threaded barrel nut.

Typically, at least a portion of the muzzle end of the barrel 20 includes an externally threaded portion 22.

A handguard 30 is typically attached to the standard barrel nut, a modified barrel nut, or the threaded portion of the upper receiver 10.

It should be appreciated that a more detailed explanation of the components of the AR-15 style upper receiver 10, the barrel 20, the handguard 30, and the other components of an AR-15 style rifle, instructions regarding how to attach and/or remove the various components and other items and/or techniques necessary for the implementation and/or operation of the various components of the AR-15 platform are not provided herein because such components are commercially available and/or such background information will be known to one of ordinary skill in the art. Therefore, it is believed that the level of description provided herein is sufficient to enable one of ordinary skill in the art to understand and practice the present disclosure as described.

It should also be appreciated that while certain exemplary embodiments of the present disclosure are shown and described as being utilized in conjunction with an AR-15 style upper receiver and/or barrel, the present disclosure is not so limited. Thus, the 3-D printed suppressor element of the present disclosure can be utilized with any firearm or other device.

FIGS. 1-7 illustrate an exemplary embodiment of a heat shielding and thermal venting system 100, according to the present disclosure. As illustrated in FIGS. 1-7, the heat shielding and thermal venting system 100 may optionally be designed so as to operate in conjunction with a shielding portion and/or a nozzle element, as shown and described in, for example, U.S. patent application Ser. No. 14/881,368, filed Oct. 13, 2015.

As illustrated, the heat shielding and thermal venting system 100 optionally includes a collar 120. The collar 120, if included, is formed so as to provide a transition between a shielding portion and/or nozzle element and a rear cap 130.

In various exemplary embodiments, the rear cap 130 (and attached or coupled shielding portion 110) can be attached, coupled, or connected to the shielding portion and/or nozzle element by the use of a flexible material tube section, or collar 120. If included, the collar 120 may be formed of a heat resistant material and or silicone impregnation to retain heat and reduce signature. In this manner, a flexible flue or chimney is formed without affecting the freefloat nature of the barrel and suppressor assembly in relation to the shielding portion 110 and the accompanying heat shielding.

The collar 120 may be of variable length and may be reinforced with wire spiral or mesh layer.

In certain exemplary embodiments, the shielding portion and/or nozzle element is formed so as to be attached or coupled to the rear cap 130, without the inclusion of the collar 120. Thus, in the heat shielding and thermal venting system 100, the rear cap 130 is configured on the end of the rifle barrel 20 that is retained by an exemplary suppressor 50 or a related muzzle device through, for example, a threaded section or a push 'friction' fit.

The rear cap 130 includes a mounting aperture 132 that allows at least a portion of the externally threaded portion 22 of the barrel 20 (or other muzzle device, such as, for example, a suppressor attachment device) to pass therethrough. In this manner, a suppressor 50 may be attached, coupled, or mounted to the barrel 20. In certain alternative embodiments, the mounting aperture 132 comprises an internally threaded mounting aperture 132, which allows the rear cap 130 to be threadedly attached to the externally threaded portion 22 of the barrel 20.

In still other embodiments, the mounting aperture 132 may be formed so as to interact with a suppressor attachment device to couple, attach, or mount the rear cap 130 to the barrel 20.

The rear cap 130 is formed so as to be attached or coupled to a shielding portion 110. The shielding portion 110 extends from a rear end 112 to a muzzle end or front end 115. The front end 115 generally forms a cap having an exit aperture 117. The shielding portion 110 and the front end 115 define an internal cavity 118 within the shielding portion 110. The rear end 112 is typically open and the internal cavity 118 is formed such that a suppressor 50 can be fully or at least partially contained within the internal cavity 118 of the shielding portion 110.

A plurality of internal supports 119 extend from the internal side walls of the shielding portion 110 at spaced apart locations. The internal supports 119 extend or protrude into the internal cavity 118. The internal supports 119 form the support for the shielding portion 110 that is positioned over the suppressor 50 to form an air gap between the suppressor surface and the inside surface of the internal cavity 118 of the shielding portion 110. The shielding portion 110 is also formed to cover the front of the suppressor 50 and a protrusion 116 is formed so as to protrude slightly forward the muzzle area of the suppressor 50. The shielding portion 110 is fixed to the rear cap 130.

The shielding portion 110 also features internal supports 119 with gaps that rest against the suppressor 50 at the front so that the entire assembly is secure to the suppressor 50 itself. The rear of the shielding portion 110 is open to allow air to be drawn in.

When an attached suppressor 50 is positioned within the internal cavity 118 and the shielding portion 110 is attached or coupled to the rear cap 130, the collar 120, and the shielding portion and/or nozzle element, the rear, sides, and a portion of the front of the suppressor 50 are contained within the heat shielding and thermal venting system 100 (leaving open the exit aperture 117, which is aligned with the exit aperture of the suppressor 50), the thermal signature of the attached suppressor 50 is reduced and/or eliminated.

One or more apertures 135 are formed in the rear cap 130. In this manner, the blast or exhaust gases that are created during a firing cycle are able to flow through any attached or coupled shielding portion and/or nozzle element, the one or more apertures 135, the air gap between the exterior of the suppressor 50 and the internal cavity 118 (as provided by the internal supports 119), and through the exit aperture 117.

Because the shielding portion 110 encases most, if not all, of the suppressor 50 and the front end 115 forms a reduced exit aperture 117, the exit aperture 117 constitutes a Venturi constriction or restricted portion, which can act to cause ambient air to be sucked into the one or more apertures 135 when the firearm is fired. An additional Venturi effect is created as air is drawn over the suppressor 50 and into the blast stream as the firearm is fired.

As the firearm is fired and a round exits the suppressor 50, blast or exhaust gas exits the muzzle and flows across the opening formed by the shielding portion 110 and protrusion 116. Through the Bernoulli Effect, air is drawn from the gap and into the blast gas. This system causes cool air to be drawn into the rear of the shielding portion 110, across the surface of the suppressor 50 and out the exit aperture 117, each time the gun is fired. It also allows a chimney or stack effect when raised or lowered. Additionally if the firearm is elevated a stack or chimney effect is induced causing air to move through the entire system.

Figure 8:
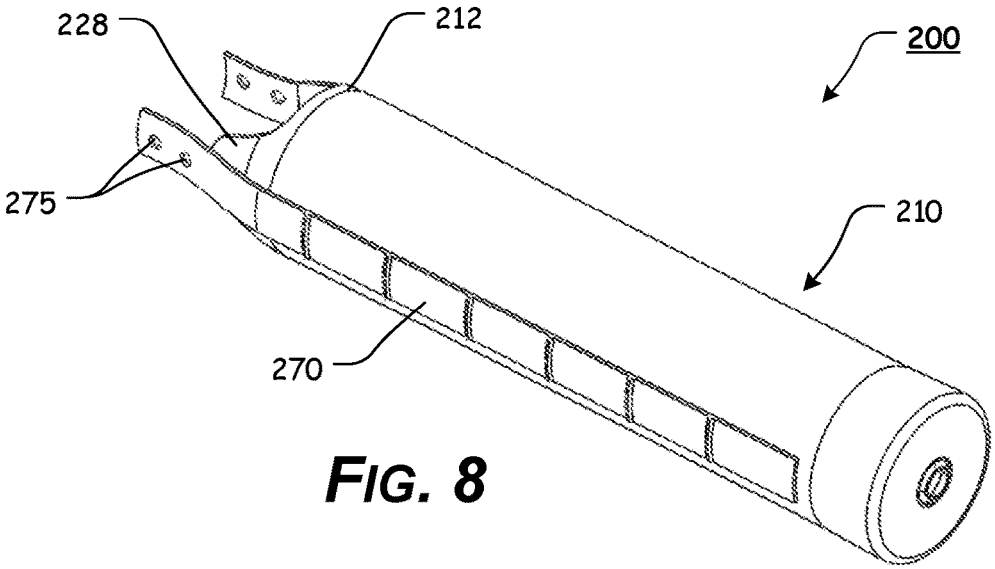
FIG. 8 illustrates a front perspective view showing certain elements of an exemplary embodiment of an outer heat shield assembly, according to the present disclosure.
Figure 9:
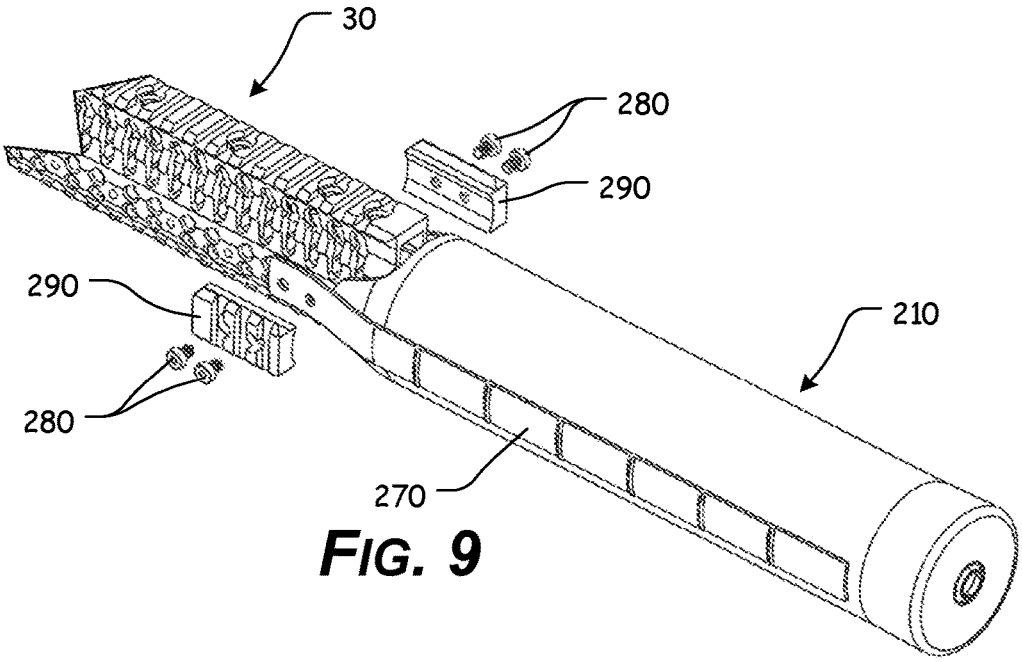
FIG. 9 illustrates a front perspective view showing certain elements of an exemplary embodiment of an outer heat shield assembly attached or coupled to an exemplary handguard, according to the present disclosure.
Figure 10:
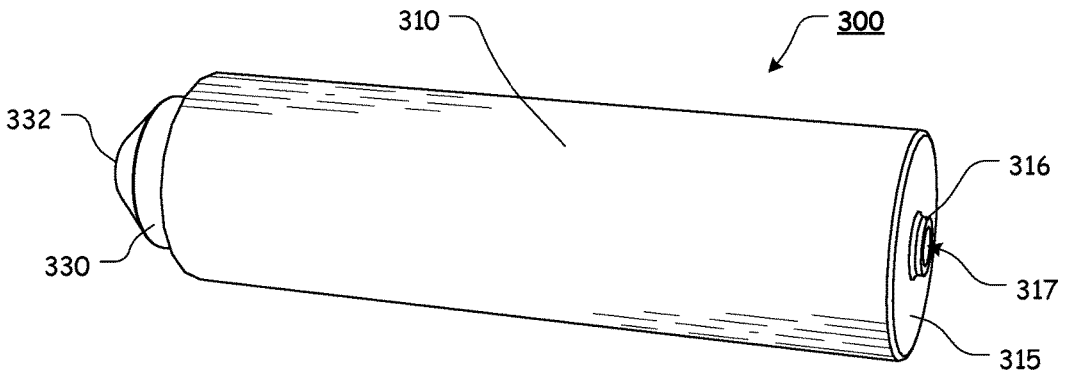
FIG. 10 illustrates a front perspective view of an exemplary embodiment of a 3-D printed suppressor element, according to the present disclosure.
Figure 11:
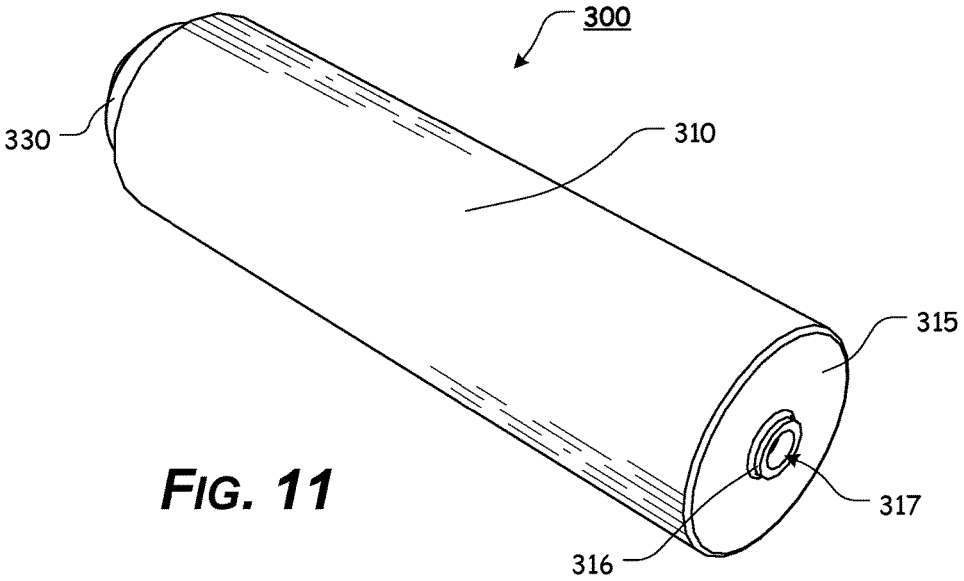
FIG. 11 illustrates a front, upper perspective view of an exemplary embodiment of a 3-D printed suppressor element, according to the present disclosure.
Figure 12:
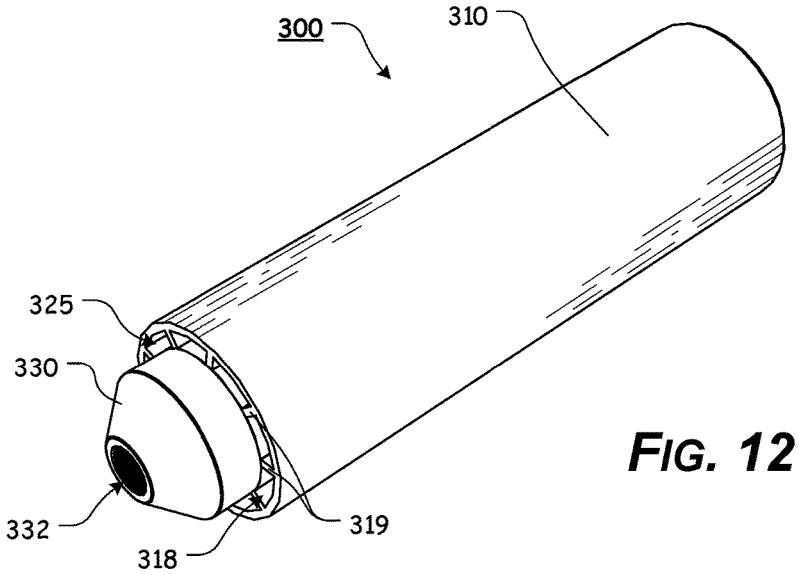
FIG. 12 illustrates a rear perspective view of an exemplary embodiment of a 3-D printed suppressor element, according to the present disclosure.
Figure 13:
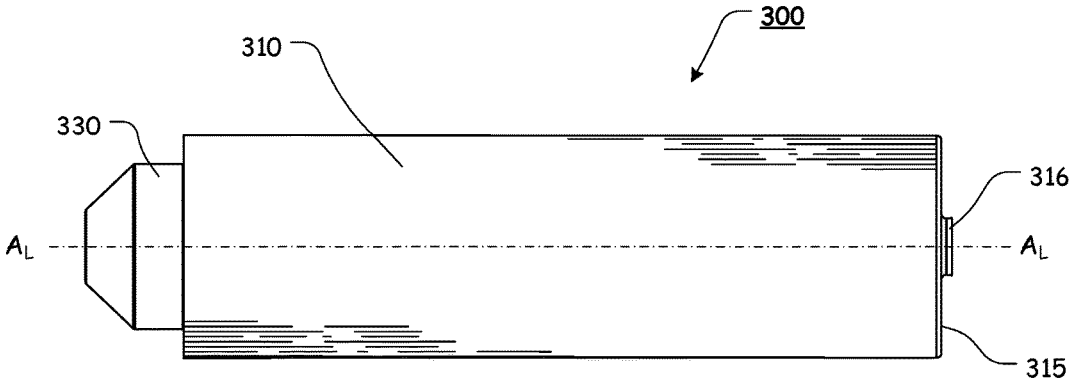
FIG. 13 illustrates a side perspective view of an exemplary embodiment of a 3-D printed suppressor element being aligned with an exemplary handguard, according to the present disclosure.
Figure 14:
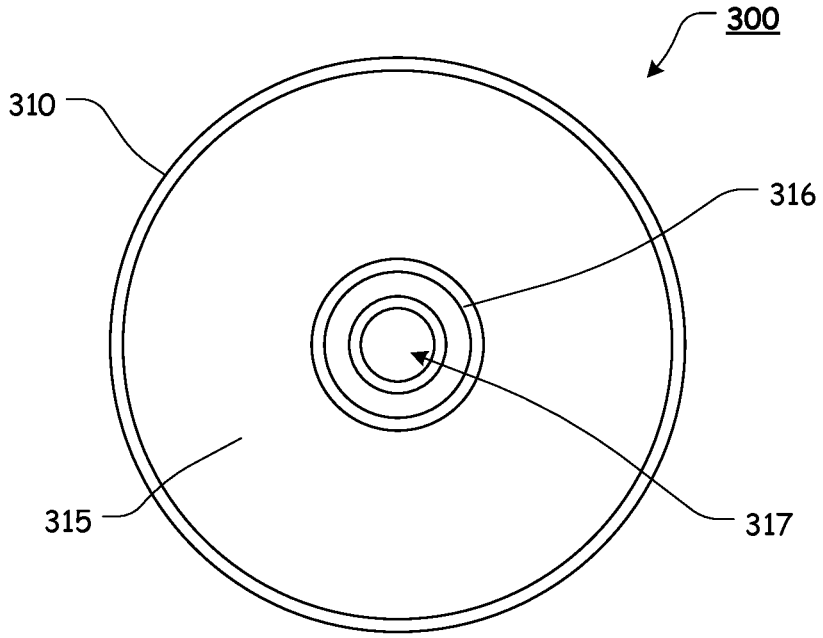
FIG. 14 illustrates a front view of an exemplary embodiment of a 3-D printed suppressor element, according to the present disclosure.
Figure 15:
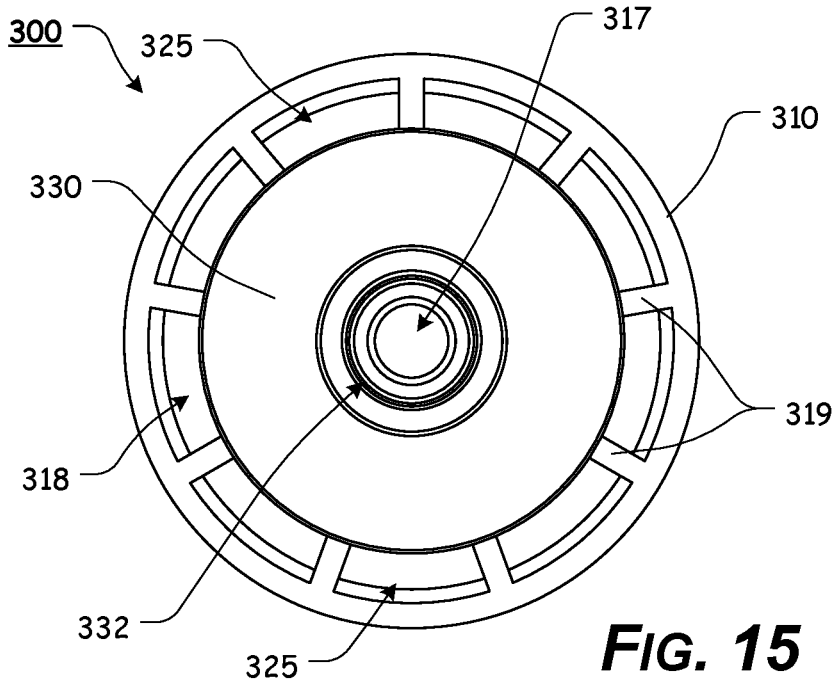
FIG. 15 illustrates a rear view of an exemplary embodiment of a 3-D printed suppressor element, according to the present disclosure.
Figure 16:
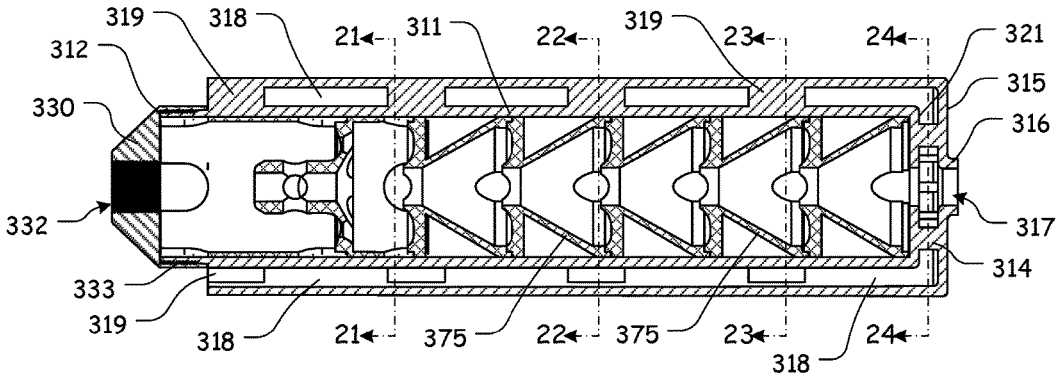
FIG. 16 illustrates a right side cross-sectional view of an exemplary embodiment of a 3-D printed suppressor element with an exemplary diffractor and exemplary baffles, according to the present disclosure.
Figure 17:
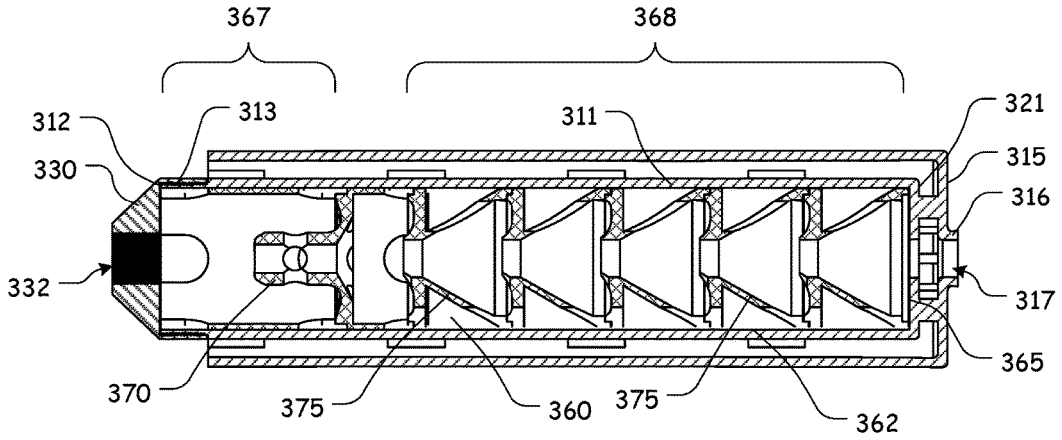
FIG. 17 illustrates a top cross-sectional view of an exemplary embodiment of a 3-D printed suppressor element with an exemplary diffractor and exemplary baffles, according to the present disclosure.
Figure 18:
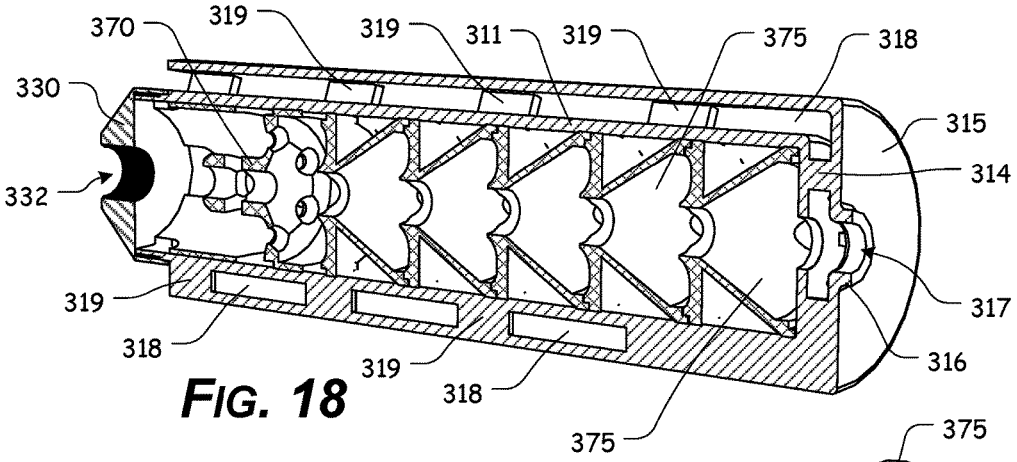
FIG. 18 illustrates a front perspective cross-sectional view of an exemplary embodiment of a 3-D printed suppressor element with an exemplary diffractor and exemplary baffles, according to the present disclosure.
Figure 19:
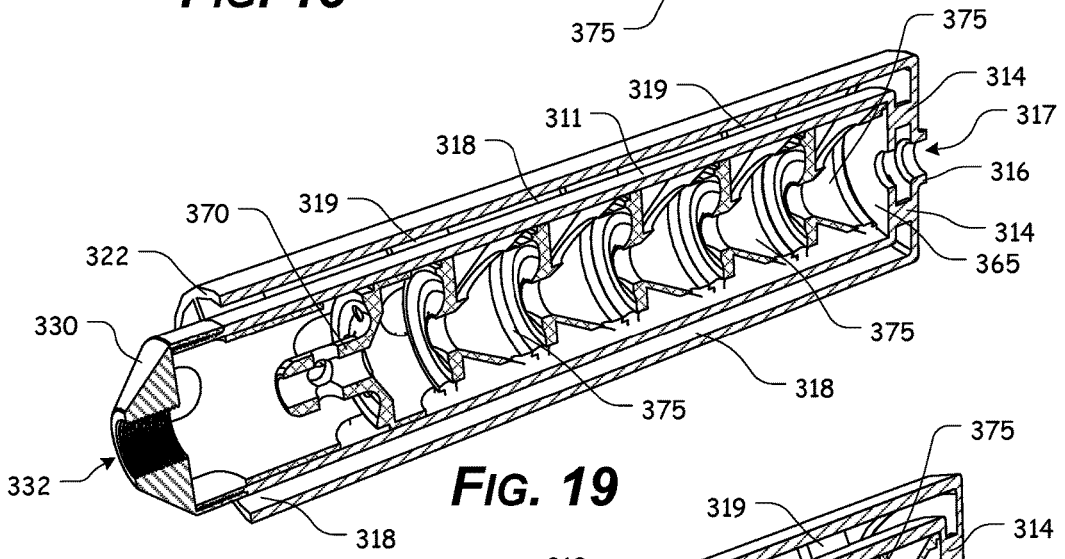
FIG. 19 illustrates a rear perspective cross-sectional view of an exemplary embodiment of a 3-D printed suppressor element with an exemplary diffractor and exemplary baffles, according to the present disclosure.
Figure 20:
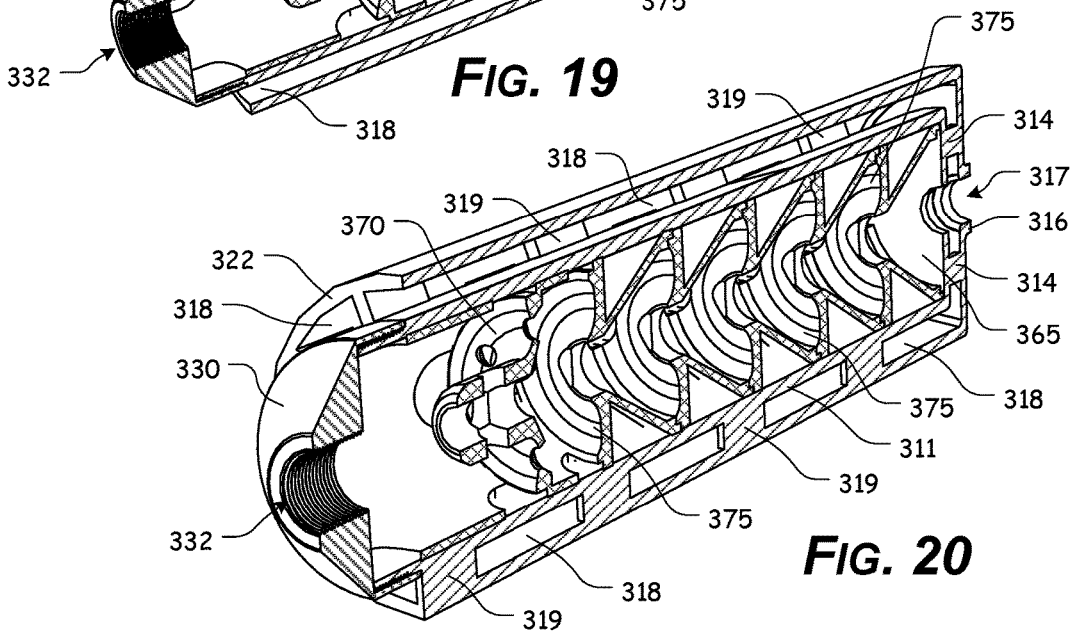
FIG. 20 illustrates an alternate rear perspective cross-sectional view of an exemplary embodiment of a 3-D printed suppressor element with an exemplary diffractor and exemplary baffles, according to the present disclosure.
Figure 21:
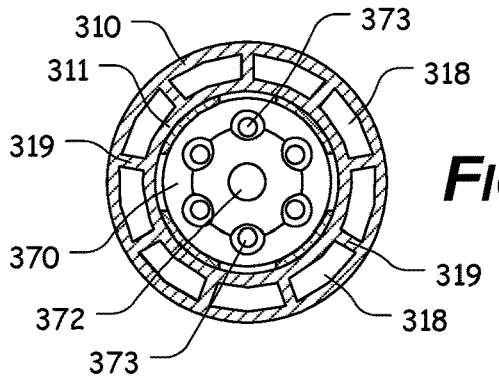
FIG. 21 illustrates a front cross-sectional view of an exemplary embodiment of a 3-D printed suppressor element with an exemplary diffractor and exemplary baffles, taken along line 21-21 of FIG. 16, according to the present disclosure.
Figure 22:
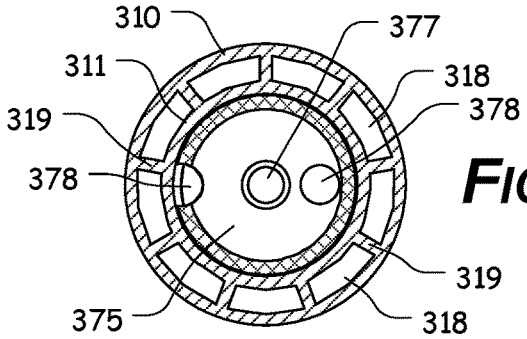
FIG. 22 illustrates a front cross-sectional view of an exemplary embodiment of a 3-D printed suppressor element with an exemplary diffractor and exemplary baffles, taken along line 22-22 of FIG. 16, according to the present disclosure.
Figure 23:
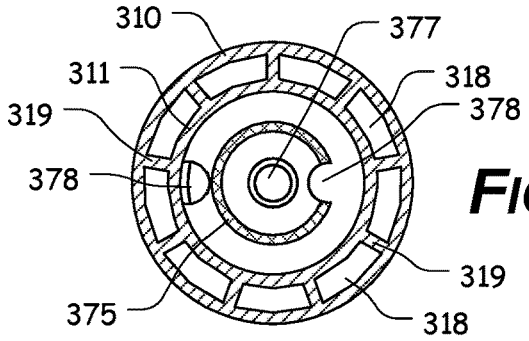
FIG. 23 illustrates a front cross-sectional view of an exemplary embodiment of a 3-D printed suppressor element with an exemplary diffractor and exemplary baffles, taken along line 23-23 of FIG. 16, according to the present disclosure.
Figure 24:
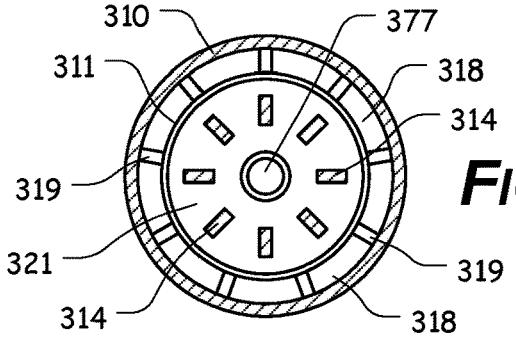
FIG. 24 illustrates a front cross-sectional view of an exemplary embodiment of a 3-D printed suppressor element, taken along line 24-24 of FIG. 16, according to the present disclosure.
Figure 25:
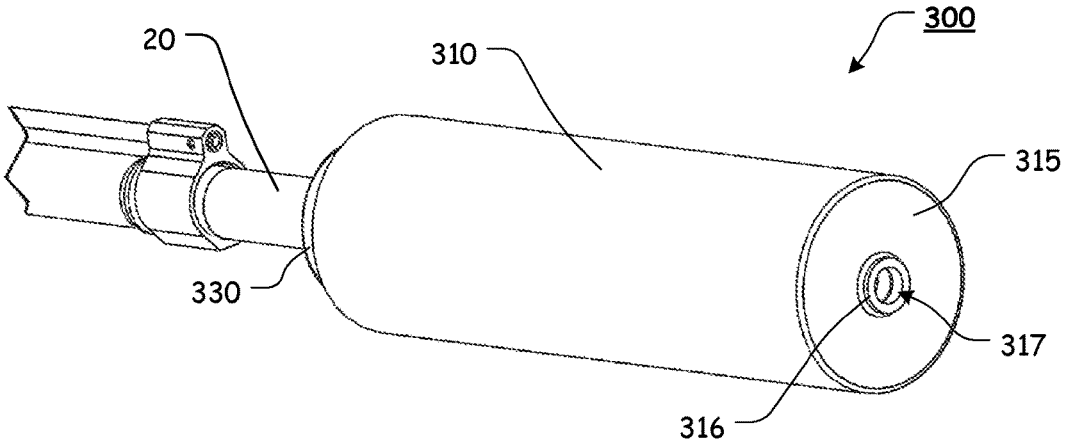
FIG. 25 illustrates a front perspective view of an exemplary embodiment of a 3-D printed suppressor element attached or coupled to an exemplary firearm barrel, according to the present disclosure.
Figure 26:
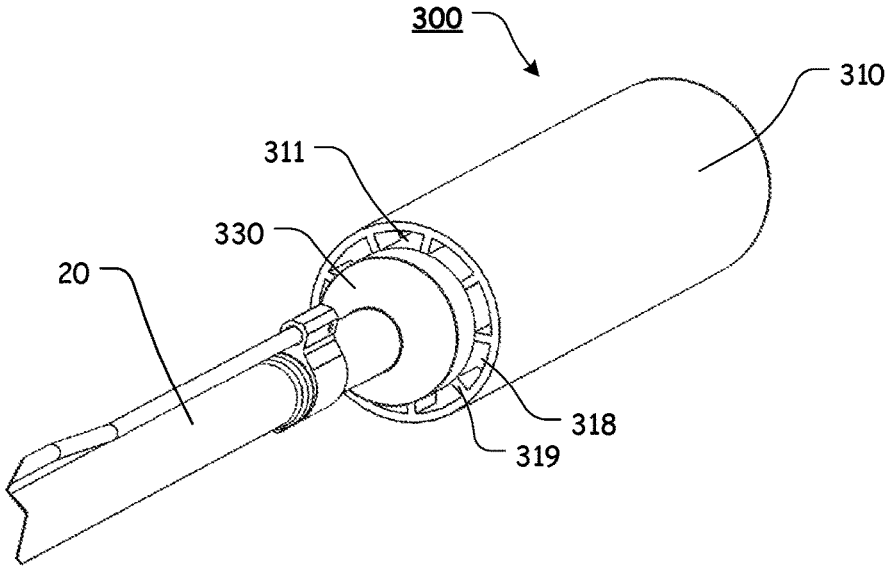
FIG. 26 illustrates a rear perspective view of an exemplary embodiment of a 3-D printed suppressor element attached or coupled to an exemplary firearm barrel, according to the present disclosure.
Figure 27:
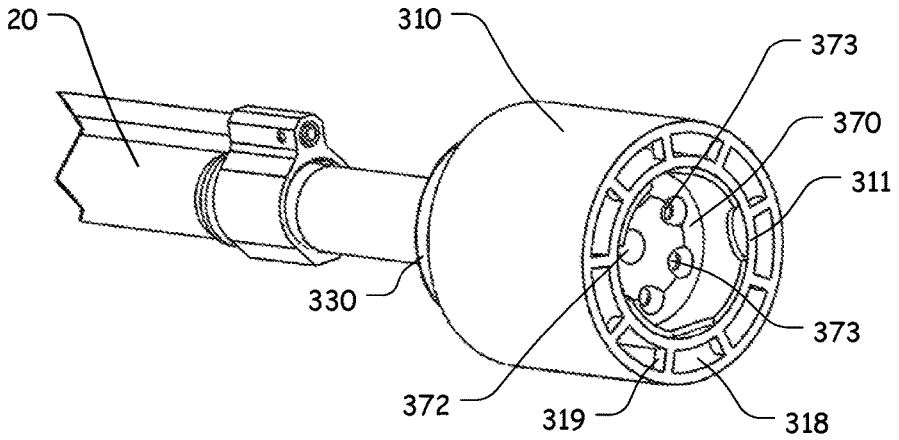
FIG. 27 illustrates a front, cross-sectional, perspective view of an exemplary embodiment of a 3-D printed suppressor element with an exemplary diffractor, attached or coupled to an exemplary firearm barrel, according to the present disclosure.
Figure 28:
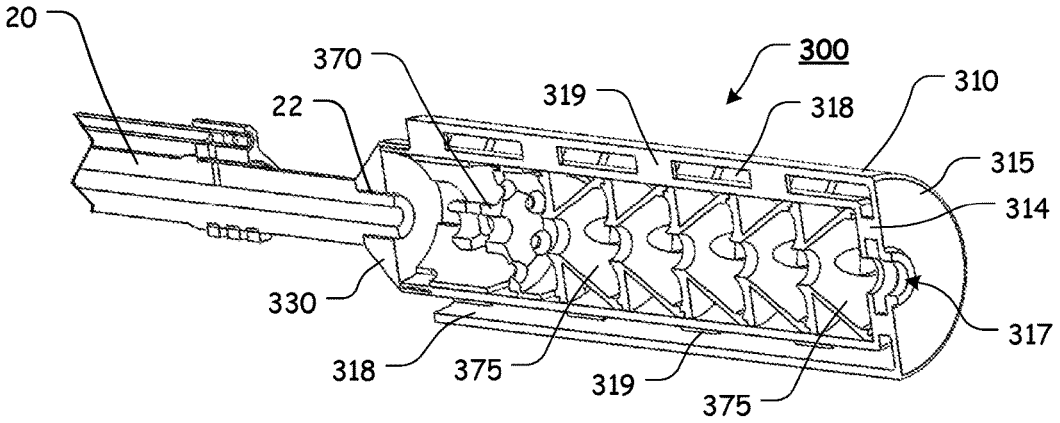
FIG. 28 illustrates a side, cross-sectional, perspective view of an exemplary embodiment of a 3-D printed suppressor element with an exemplary diffractor and exemplary baffles attached or coupled to an exemplary firearm barrel, according to the present disclosure.

FIGS. 8-9 illustrate an exemplary embodiment of a heat shielding and thermal venting system 200, according to the present disclosure. As illustrated in FIGS. 8-9, the heat shielding and thermal venting system 200 is designed so as to operate with or without a shielding portion or shielding portion. As illustrated, the heat shielding of thermal venting system 200 includes a shielding portion 210. The shielding portion 210 includes elements similar to those of the shielding portion 110.

However, in certain exemplary embodiments, the shielding portion 210 optionally includes an extension portion 228 that extends from the rear end 212. The extension portion 228, if included, is formed so as to extend toward, and optionally at least partially around a portion of the handguard 30.

The shielding portion 210 provides a cover or 'sock' that is able to cover all or at least a portion of a suppressor.

The heat shielding and thermal venting system 200 further comprises a strap element 270 that is attached or coupled to an outer surface of the shielding portion 210 and extends rearward so that the strap element 270 may be attached or coupled to the handguard 30. In various exemplary embodiments, the strap element 270 is attached or coupled to the handguard 30 via interaction of bolts or screws 290, apertures 275 formed in the strap element 270, and apertures formed in the handguard 30.

The strap elements 270 may also be used to retain the shielding portion 210 in place relative to the handguard 30. The strap elements 270 attach to the handguard 30, while retaining the shielding portion 210 in place at the front.

In certain exemplary embodiments, the strap elements 270 provide attachment points along their respective lengths using a 'molle' or similar attachment system. Additionally, attachable rail portions 290 may also be attached or coupled, via the bolts or screws 290.

FIGS. 10-31 illustrate an exemplary embodiment of a 3-D printed suppressor element 300, according to the present disclosure. As illustrated in FIGS. 10-31, the 3-D printed suppressor element 300 optionally includes a suppressor body portion 311, a suppressor shielding portion 310, and a rear cap 330.

In various exemplary, nonlimiting embodiments, the body portion 311 extends, along a longitudinal axis $A_L$, from a rear end 312 to a front end 321. One or more interior side walls 362 extend from the open rear end 312 to a bottom wall 365. A body cavity 360 is defined between the open first end 312, the side wall(s) 362 and the bottom wall 365. In various exemplary embodiments, the first end 312 includes an externally threaded portion 313.

An exit aperture 317 is formed in the bottom wall 365. In various exemplary embodiments, the exit aperture 317 is formed proximate a center of the bottom wall 365. Alternatively, the exit aperture 317 may be formed offset from the center of the bottom wall 365. It should be appreciated that the size and shape of the exit aperture 317 is a design choice, based upon the caliber or range of calibers of a projectile with which the 3-D printed suppressor element 300 is to be utilized.

The body cavity 360 is generally formed so as to include an expansion chamber portion 367 and a baffle stack chamber portion 368. In various exemplary embodiments, the expansion chamber portion 367 is formed so as to receive a diffractor 370 at least partially therein, while the baffle stack chamber portion 368 is formed so as to receive one or more baffles 375 therein.

The diffractor 370 includes a central aperture 372 that, when aligned within the body cavity 360 is aligned with the exit aperture 317 of the body portion 311 and the shielding portion 310. In certain exemplary embodiments, a variety of supplemental apertures 373 are also through portions of the diffractor 370.

In various exemplary embodiments, each baffle 375 comprises a substantially conical baffle, which is capable of being interlocked and stackable with adjacent baffles 375. Each baffle 375 includes a central aperture 377 that, when aligned within the body cavity 360 is aligned with the exit aperture 317 of the body portion 311 and the shielding portion 310.

In various exemplary embodiments, the deflector 370 and/or baffles 375 are formed of stainless steel, aluminum, titanium, or alloys such as Inconel, and are either machined out of solid metal or stamped out of sheet metal. Alternatively, the deflector 370 and/or baffles 375 may be formed of one or more of the following: plastic, glass-hardened polymers, polymeric composites, polymer or fiber reinforced metals, carbon fiber or glass fiber composites, carbon fiber resin, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the deflector 370 and/or baffles 375 is a design choice based on the desired functionality of the the deflector 370 and/or baffles 375.

In certain exemplary embodiments, a variety of supplemental apertures 378 are formed through portions of each baffle 375.

In various exemplary embodiments, the baffles 375 are stacked to form metal dividers, which separate the expansion chambers within the body cavity 360.

In certain exemplary embodiments, a desired number of baffles 375 can be interlocked to form a baffle stack, to be positioned within the baffle stack chamber portion 368 of the body cavity 360.

In certain exemplary embodiments, the expansion chamber portion 367 is formed so as to optionally accept a Nielsen device or other recoil booster components to aid in the use of the 3-D printed suppressor element 300 with certain firearms or other devices.

A plurality of support elements 319 extend from external side walls of the body portion 311 at spaced apart locations. The support elements 319 extend or protrude from the body portion 311 to interior side wall surfaces of the shielding portion 310. In various exemplary embodiments, additional support elements 314 extend from the front end 321 to contact the bottom wall of the shielding portion 310.

In various exemplary, nonlimiting embodiments, the shielding portion 310 extends, along a longitudinal axis $A_L$, from a rear end 322 to a front end 315. One or more interior side walls extend from the open rear end 322 to the bottom wall of the shielding portion 310.

The support elements 319 form the support for the shielding portion 310 that is positioned over at least a portion of the body portion 311 to form an air gap (venting cavity 318) between the exterior surface of the body portion 311 and the interior surface of the shielding portion 310. The shielding portion 310 is also formed to cover the front of the body portion 311 and a protrusion 316 is formed so as to protrude slightly forward the front end 315 of the shielding portion 310. Thus, the front end 315 generally forms a cap, including the exit aperture 317.

The venting cavity 318 is defined between support elements 319, the exterior of the body portion 311, and the interior sidewalls of the shielding portion 310. In various exemplary embodiments, the venting cavity 318 is further defined between the additional support elements 314, the front and 321 of the body portion 311, and the bottom wall of the shielding portion 310.

The body portion 311 and the shielding portion 310 are arranged such that the body portion 311 is fully or at least partially contained within the shielding portion 310. Furthermore, the venting cavity 318 is in fluid communication with air outside of the 3-D printed suppressor element 300, proximate the rear end 322 of the shielding portion 310 (via venting cavity entry apertures 325) and through the exit aperture 317. Thus, fluid communication between the venting cavity 318 and an exterior of the 3-D printed suppressor element 300 is provided.

Because of the shape of the cavity of the venting cavity 318, a Venturi effect is created within the venting cavity 318, especially during the firing cycle, causing air motion to speed up within the venting cavity 318, enhancing the draw, or flow, of air and increasing cooling within the venting cavity 318. Because of the principle of conservation of momentum, the Venturi effect created within the venting cavity means that as air moves through the venting cavity 318, toward the exit aperture 317, fresh, outside, ambient air is drawn into the venting cavity 318, through the venting cavity entry apertures 325.

It should be appreciated that these airflow affects may be either passive (i.e., occurring without interaction from firing the weapon) or active (i.e., occurring through the act of firing the weapon and utilizing blast gas in operation).

Thus, if the firearm is fired, either Venturi or Bernoulli effects cause the faster muzzle gas to draw warm air from around the body portion 311, through the exit aperture 317, where the ambient air is mixed with the blast gas and removed. At the same time, typically cooler, ambient air is drawn through the one or more venting cavity entry apertures 325 and into the interior of the venting cavity 318.

It should be appreciated that while the venting cavity entry apertures 325 are primarily shown and described as being arcuate or semicircular, and formed proximate the rear end 322 of the shielding portion 310, any number of venting cavity entry apertures 325 may be formed at any position along the shielding portion 310 and may take any desired size, shape, or form.

Because of the configuration of the venting cavity 318, airflow can be created within the venting cavity 318 between the one or more venting cavity entry apertures 325 and the exit aperture 317. This results in the creation of a 'stack effect' or 'chimney effect' by the temperature and pressure difference between warmer air within the venting cavity 318 and cooler, ambient temperature air outside the shielding portion 310, as hot air rises and draws in cooler air from outside. When the firearm and handguard/heat shield tube assembly are elevated or lowered a 'stack effect' is induced similar to a chimney or flue system.

Thus, due to the chimney like nature of the design, when the firearm is generally pointed upward or downward, cooler, ambient air from outside the shielding portion 310 is drawn in at the bottom-most end, as the heat rises. This results in an efficient cooling system as the cooler air is drawn into the venting cavity 318 (either through the one or more venting cavity entry apertures 325 or the exit aperture 317—depending on which end is pointed downward) and directed along the entire length of the shielding portion 310, where continuous convective heat transfer results in effective cooling.

The rear cap 330 includes an internally threaded portion 333, having internal threads formed so as to interact with at least a portion of the externally threaded portion 313. In this manner, the rear cap 330 can be threadedly attached to or removed from the body portion 311. In various exemplary embodiments, the rear cap 330 can be removed from the body portion 311 to allow baffles 375 and/or a diffractor 370 to be appropriately positioned within the body cavity 360. Once the baffles 375 and/or diffractor 370 are appropriately positioned, the rear cap 330 can be threadedly attached to the body portion 311, thereby maintaining the baffles 375 and/or diffractor 370 within the body cavity 360.

In various exemplary embodiments, the rear cap 330 includes a mounting aperture 332, which allows the rear cap 330 (and ultimately the body portion 311) to be attached or coupled to, for example, the barrel 20 of a firearm. In various exemplary embodiments, the rear cap 330 includes an internally threaded mounting aperture 332 that allows at least a portion of the externally threaded portion 22 of the barrel 20 (or other muzzle device, such as, for example, a suppressor attachment device) to be threaded the attached or coupled to the barrel 20. In this manner, the 3-D printed suppressor element 300 may be attached, coupled, or mounted to the barrel 20.

In still other embodiments, the mounting aperture 332 may be formed so as to interact with a suppressor attachment device to couple, attach, or mount the rear cap 330 to the barrel 20.

Because the body portion 311 and the shielding portion 310 are attached or joined to one another via one or more of the support elements 319 and/or the additional support elements 314, the body portion 311, the shielding portion 310, and the one or more support elements 319 and/or additional support elements 314 may be formed as an integral unit. Thus, the 3-D printed suppressor element 300, comprising the body portion 311, the shielding portion 310, and the one or more support elements 319 and/or additional support elements 314 may be formed as an integral, 3-D printed unit.

In various exemplary embodiments, at least the body portion 311, the shielding portion 310, and the one or more support elements 319 and/or additional support elements 314 are 3-D printed utilizing, for example, extrusion deposition modeling (EDM), fused deposition modeling (FDM), fused filament fabrication (FFF), robocasting or direct ink writing (DIW), binding of granular materials or powder bed methods such as, for example, powder bed and inkjet head 3D printing (3DP), electron-beam melting (EBM), selective laser melting (SLM), selective heat sintering (SHS), selective laser sintering (SLS), inkjet 3D printing, or direct metal laser sintering (DMLS), lamination methods such as, for example, laminated object manufacturing (LOM), light or other photopolymerization or other photosculpture methods such as, for example, stereolithography (SLA), digital Light Processing (DLP), powder fed methods such as, for example, directed energy deposition (DED), or wire methods such as, for example, electron beam freeform fabrication ($EBF^3$).

Thus, using various 3-D printing methods, at least the body portion 311, the shielding portion 310, and the one or more support elements 319 and/or additional support elements 314 may be formed of a variety of materials, such as, for example, thermoplastics, eutectic metals, edible materials, Rubbers, Modeling clay, Plasticine, Metal clay (including Precious Metal Clay), ceramic materials, metal alloy, cermet, metal matrix composite, ceramic matrix composite, photopolymer, powdered polymers, plaster, a metal alloy including Titanium alloys, Cobalt Chrome alloys, stainless steel, aluminum, thermoplastic powder, thermoplastics, metal powders, ceramic powders, paper, metal foil, plastic film.

Figure 29:
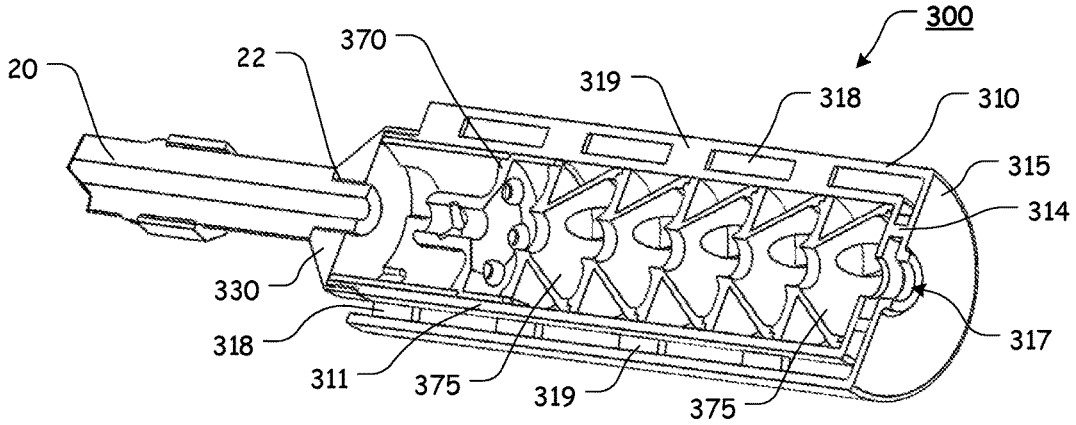
FIG. 29 illustrates an alternate side, cross-sectional, perspective view of an exemplary embodiment of a 3-D printed suppressor element with an exemplary diffractor and exemplary baffles attached or coupled to an exemplary firearm barrel, according to the present disclosure.
Figure 30:
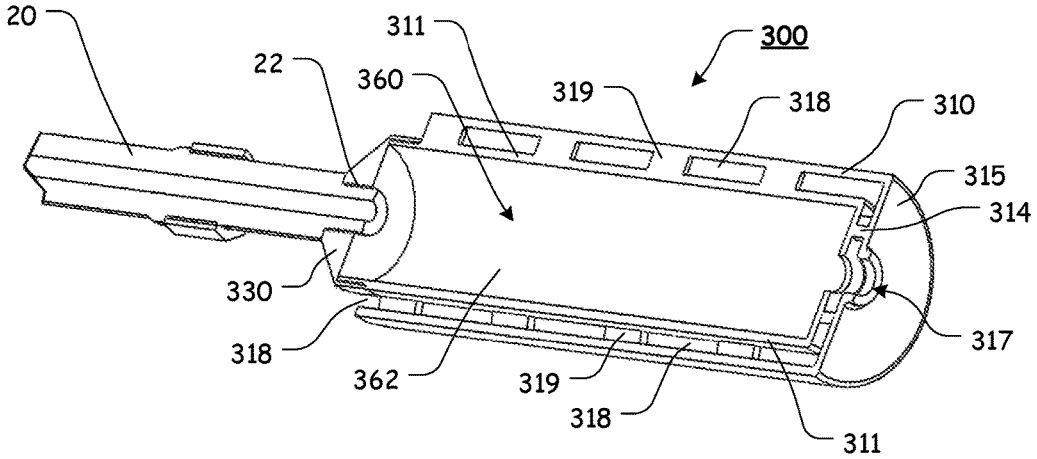
FIG. 30 illustrates a side, cross-sectional, perspective view of an exemplary embodiment of a 3-D printed suppressor element, without a diffractor or baffles, attached or coupled to an exemplary firearm barrel, according to the present disclosure.
Figure 31:
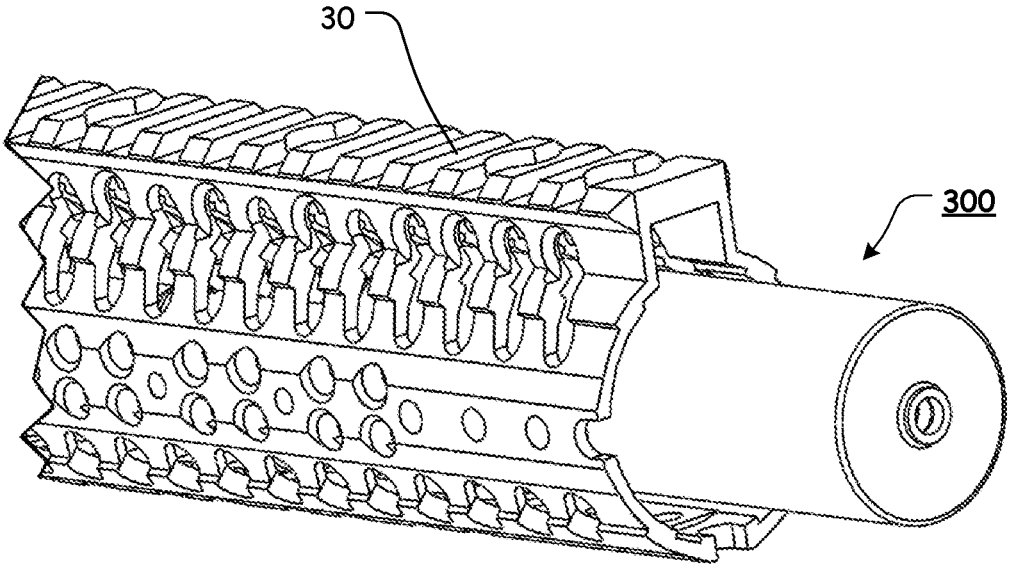
FIG. 31 illustrates a partial, front perspective view of an exemplary embodiment of a 3-D printed suppressor element being at least partially positioned within an exemplary handguard, according to the present disclosure.

In these exemplary embodiments, as illustrated most clearly in FIG. 29, at least the body portion 311, the shielding portion 310, and the one or more support elements 319 and/or additional support elements 314 are 3-D printed as an integral unit. It should be appreciated that the rear cap 330 may be 3-D printed as a separate unit or may be formed using alternate methods. As illustrated most clearly in FIG. 30, the baffles 375 and/or a diffractor 370 may be appropriately positioned within the body cavity 360 and the rear cap 330 can be threadedly attached to the body portion 311, thereby maintaining the baffles 375 and/or diffractor 370 within the body cavity 360. The assembled 3-D printed suppressor element 300 may then be attached or coupled to an exemplary barrel 20, utilizing the rear cap 330.

In certain exemplary, nonlimiting embodiments, at least the body portion 311, the shielding portion 310, the one or more support elements 319 and/or additional support elements 314, the baffles 375, and/or a diffractor 370 are 3-D printed as an integral unit. In these exemplary embodiments, the rear cap 330 may be formed as a separate element or may also be 3-D printed as part of the integral unit.

Unlike known suppressors or suppressor bodies, some or all of the components of the 3-D printed suppressor element 300, with or without baffles and/or a diffractor may be generated using 3-D printing or additive manufacturing (AM) processes technology. Thus, at least some of the body portion 311, the shielding portion 310, the one or more support elements 319 and/or additional support elements 314, the baffles 375, and/or a diffractor 370 are generated using 3-D printing or additive manufacturing by depositing a layer of material and building subsequent layers of material to form the 3-D printed suppressor element 300.

A more detailed explanation of the 3-D printing or additive manufacturing process are not provided herein because such 3-D printing or additive manufacturing processes are commercially known and/or such background information will be known to one of ordinary skill in the art. Therefore, it is believed that the level of description provided herein is sufficient to enable one of ordinary skill in the art to understand and practice the present disclosure, as described.

While the present disclosure has been described in conjunction with the exemplary embodiments outlined above, the foregoing description of exemplary embodiments of the present disclosure, as set forth above, are intended to be illustrative, not limiting and the fundamental disclosure should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A suppressor element, comprising:

a body portion extending along a longitudinal axis, from a body portion rear end to a body portion front end, wherein one or more interior body portion side walls extend from said body portion rear end to a body portion bottom wall, wherein a body cavity is defined between said body portion rear end, said body portion side wall(s) and said body portion bottom wall, wherein a body portion exit aperture is formed through said body portion bottom wall, and wherein said body portion rear end includes an externally threaded portion;

a shielding portion extending along a longitudinal axis, from an open shielding portion rear end to a shielding portion front end, wherein one or more interior shielding portion side walls extend from said open shielding portion rear end to a shielding portion bottom wall, wherein a shielding portion exit aperture is formed through said shielding portion bottom wall, wherein said shielding portion is positioned over at least a portion of said body portion, such that said body portion exit aperture is aligned with said shielding portion exit aperture, wherein a venting cavity is defined between at least a portion of said body portion and at least a portion of said shielding portion, and wherein a protrusion is formed so as to extend from said shielding portion front end around at least a portion of said exit aperture; one or more support elements extending, at spaced apart locations, between said body portion and said shielding portion, wherein said one or more support elements are each integral to said body portion and integral to said shielding portion;

a plurality of additional support elements extending, at spaced apart, discrete locations, between said body portion front end and said shielding portion bottom wall, wherein said plurality of additional support elements are each integral to said body portion and integral to said shielding portion, and wherein said plurality of additional support elements create an open configuration such that said venting cavity extends between said body portion front end and said shielding portion bottom wall and said vent cavity extends around each of said plurality of additional support elements;

one or more baffles formed within said body cavity; and a rear cap having an internally threaded portion, having internal threads formed so as to interact with at least a portion of said externally threaded portion of said body portion rear end, and wherein said rear cap includes a mounting aperture, wherein said mounting aperture allows said rear cap to be attached or coupled to a barrel or muzzle device of a firearm.

2. The suppressor element of claim 1, wherein said exit aperture is formed proximate a center of said body portion bottom wall.

3. The suppressor element of claim 1, wherein said exit aperture is formed offset from said center of said body portion bottom wall.

4. The suppressor element of claim 1, wherein said body cavity comprises an expansion chamber portion and a baffle stack chamber portion.

5. The suppressor element of claim 1, wherein said shielding portion bottom wall covers at least a portion of said body portion front end.

6. The suppressor element of claim 1, wherein said body portion and said shielding portion are arranged such that said body portion is fully contained within said shielding portion.

7. The suppressor element of claim 1, wherein said rear cap is repeatably threadedly attachable to or removable from said body portion.

8. The suppressor element of claim 1, wherein said rear cap is threadedly attached to said body portion.

9. The suppressor element of claim 1, wherein said mounting aperture comprises an internally threaded mounting aperture.

10. The suppressor element of claim 1, wherein said mounting aperture is releasably attachable to a suppressor attachment device or a muzzle device.

11. The suppressor element of claim 1, wherein said venting cavity extends from one or more venting cavity entry apertures formed proximate said shielding portion rear end to said shielding portion exit aperture.

12. The suppressor element of claim 11, wherein each of said one or more venting cavity entry apertures is defined between adjacent support elements, said body portion, and said shielding portion, proximate said shielding portion rear end.

13. The suppressor element of claim 11, wherein fluid communication between said venting cavity and an exterior of said shielding portion is provided by said one or more venting cavity entry apertures and said shielding portion exit aperture.

14. The suppressor element of claim 1, wherein said body portion, said shielding portion, said one or more support elements, and said plurality of additional support elements are formed as an integral or monolithic unit.

15. The suppressor element of claim 1, wherein said body portion, said shielding portion, said one or more support elements, said plurality of additional support elements, and said one or more baffles are formed as an integral or monolithic unit.

16. A suppressor element, comprising:

a body portion extending along a longitudinal axis, from a body portion rear end to a body portion front end, wherein one or more interior body portion side walls extend from said body portion rear end to a body portion bottom wall, wherein a body cavity is defined between said body portion rear end, said body portion side wall(s) and said body portion bottom wall, wherein a body portion exit aperture is formed through said body portion bottom wall, and wherein said body portion rear end includes an externally threaded portion;

a shielding portion extending along a longitudinal axis, from an open shielding portion rear end to a shielding portion front end, wherein one or more interior shielding portion side walls extend from said open shielding portion rear end to a shielding portion bottom wall, wherein a shielding portion exit aperture is formed through said shielding portion bottom wall, wherein said shielding portion is positioned over at least a portion of said body portion, such that said body portion exit aperture is aligned with said shielding portion exit aperture, wherein a venting cavity is defined between at least a portion of said body portion and at least a portion of said shielding portion, and wherein said venting cavity extends from one or more venting cavity entry apertures formed proximate said open shielding portion rear end to said shielding portion exit aperture;

one or more support elements extending, at spaced apart locations, between said body portion and said shielding portion;

a plurality of additional support elements extending, at spaced apart, discrete locations, between said body portion front end and said shielding portion bottom wall, wherein said plurality of additional support elements are each integral to said body portion and integral to said shielding portion, wherein said body portion, said shielding portion, said one or more support elements, and said plurality of additional support elements are formed as an integral or monolithic unit, and wherein said plurality of additional support elements create an open configuration such that said venting cavity extends between said body portion front end and said to shielding portion bottom wall and said vent cavity extends around each of said plurality of additional support elements;

one or more baffles formed within a portion of said body cavity; and a rear cap having an internally threaded portion, having internal threads formed so as to interact with at least a portion of said externally threaded portion of said body portion rear end, and wherein said rear cap includes a mounting aperture, wherein said mounting aperture allows said rear cap to be attached or coupled to a barrel or muzzle device of a firearm.

17. The suppressor element of claim 16, wherein said body portion, said shielding portion, said one or more support elements, said one or more baffles, and said plurality of additional support elements are formed as an integral or monolithic unit.

18. The suppressor element of claim 16, wherein said one or more baffles are formed as an integral or monolithic unit.

19. A suppressor element, comprising:

a body portion having a body cavity defined therein and a body portion exit aperture formed through a body portion bottom wall;

a shielding portion having a shielding portion exit aperture formed through a shielding portion bottom wall, wherein said shielding portion is positioned over at least a portion of said body portion, such that said body portion exit aperture is aligned with said shielding portion exit aperture, and wherein a venting cavity is defined between at least a portion of said body portion and at least a portion of said shielding portion;

one or more support elements extending, at spaced apart locations, between said body portion and said shielding portion;

a plurality of additional support elements extending, at spaced apart, discrete locations, between said body portion front end and said shielding portion bottom wall, wherein said plurality of additional support elements are each integral to said body portion and integral to said shielding portion, and wherein said plurality of additional support elements create an open configuration such that said venting cavity extends between said body portion front end and said shielding portion bottom wall and said venting cavity extends around each of said plurality of additional support elements;

one or more baffles positioned within a portion of said body cavity; and a rear cap extending from said body portion, wherein said rear cap includes a mounting aperture that allows said rear cap to be attached or coupled to a barrel or muzzle device of a firearm, and wherein at least said body portion, said shielding portion, and said one or more support elements, and said plurality of additional support elements are formed as an integral or monolithic unit.

20. The suppressor element of claim 19, wherein said exit aperture is formed proximate a center of said body portion bottom wall.

* * * * *